US012090374B2

(12) United States Patent
Wada et al.

(10) Patent No.: US 12,090,374 B2
(45) Date of Patent: Sep. 17, 2024

(54) GOLF CLUB HEAD

(71) Applicant: BRIDGESTONE SPORTS CO., LTD., Tokyo (JP)

(72) Inventors: Kozue Wada, Tokyo (JP); Takaharu Takechi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 18/060,744

(22) Filed: Dec. 1, 2022

(65) Prior Publication Data

US 2023/0201678 A1 Jun. 29, 2023

(30) Foreign Application Priority Data

Dec. 23, 2021 (JP) ..... 2021-209203

(51) Int. Cl.
*A63B 53/06* (2015.01)
*A63B 53/04* (2015.01)

(52) U.S. Cl.
CPC ..... *A63B 53/0475* (2013.01); *A63B 53/0408* (2020.08)

(58) Field of Classification Search
CPC ..... A63B 53/0475; A63B 53/0429
See application file for complete search history.

(56) References Cited

U.S. PATENT DOCUMENTS

| | | | | |
|---|---|---|---|---|
| 11,400,352 | B1 * | 8/2022 | Parsons | A63B 53/0412 |
| 2005/0037864 | A1 | 2/2005 | Gilbert et al. | |
| 2007/0161433 | A1 | 7/2007 | Yokota | |
| 2008/0032815 | A1 | 2/2008 | Yamamoto | |
| 2009/0247314 | A1 * | 10/2009 | Matsunaga | A63B 53/047 473/291 |
| 2014/0038747 | A1 | 2/2014 | Dolezel et al. | |
| 2015/0360099 | A1 * | 12/2015 | Ban | A63B 53/06 473/324 |
| 2017/0014691 | A1 * | 1/2017 | Takechi | A63B 53/04 |
| 2017/0095708 | A1 * | 4/2017 | Ripp | A63B 53/06 |
| 2018/0028883 | A1 | 2/2018 | Morin et al. | |
| 2020/0188743 | A1 | 6/2020 | Kitagawa | |

FOREIGN PATENT DOCUMENTS

| | | |
|---|---|---|
| JP | 2005-058765 | 3/2005 |
| JP | 2007-181616 | 7/2007 |
| JP | 2008-036006 | 2/2008 |
| JP | 2012-525214 | 10/2012 |
| JP | 2014-033968 | 2/2014 |
| JP | 2016-002136 | 1/2016 |
| JP | 2018-015565 | 2/2018 |
| JP | 2020-092906 | 6/2020 |
| WO | 2010/126729 | 11/2010 |

* cited by examiner

*Primary Examiner* — Raeann Gorden
(74) *Attorney, Agent, or Firm* — IPUSA, PLLC

(57) ABSTRACT

A golf club head according to the disclosure is a cavity-back iron type golf club head that includes a face portion and a back portion. The face portion includes a front face and a rear face facing away from each other, the front face being a ball-striking face. A non-metallic member is fixed to the rear face. An abutment portion including a tip portion with a curved surface is provided on the back portion. The abutment portion is passed through the back portion, and the curved surface of the tip portion contacts the non-metallic member.

8 Claims, 7 Drawing Sheets

GOLF CLUB HEAD

CROSS-REFERENCE TO RELATED APPLICATIONS

This application is based upon and claims priority to Japanese Patent Application No. 2021-209203 filed on Dec. 23, 2021, the entire contents of which are incorporated herein by reference.

BACKGROUND OF THE INVENTION

1. Field of the Invention

The present invention relates to golf club heads.

2. Description of the Related Art

Conventionally, for example, to fortify a face portion of an iron-type golf club head and to adjust the stiffness distribution in the iron-type golf club head, there have been proposals to provide an abutment portion that abuts a rear face of the face portion (for example, see Japanese Patent Application Publication Nos. 2005-058765, 2007-181616, 2008-036006, 2014-033968, 2018-015565, 2016-002136, 2020-092906, and PCT International Application Publication No. 2012-525214).

In such a golf club head, impact acts on the face portion each time a golf ball is struck, and the impact is also transmitted to the abutment portion that abuts the rear face of the face portion. Therefore, it is desirable to improve the durability of the abutment portion in such a golf club head.

SUMMARY OF THE INVENTION

A golf club head according to one aspect of the disclosure is a cavity-back iron type golf club head that includes a face portion and a back portion. The face portion includes a front face and a rear face facing away from each other, the front face being a ball-striking face. A non-metallic member is fixed to the rear face. An abutment portion including a tip portion with a curved surface is provided on the back portion. The abutment portion is passed through the back portion, and the curved surface of the tip portion contacts the non-metallic member.

DETAILED DESCRIPTION OF EMBODIMENTS

An object of this disclosure is to provide a golf club head with a more durable abutment portion.

According to the techniques of the disclosure, a golf club head with a more durable abutment portion can be provided.

An embodiment will be described with reference to the accompanying drawings. Note that the same reference symbols denote the same components throughout the drawings, and a redundant description thereof may be omitted.

Figure 1:
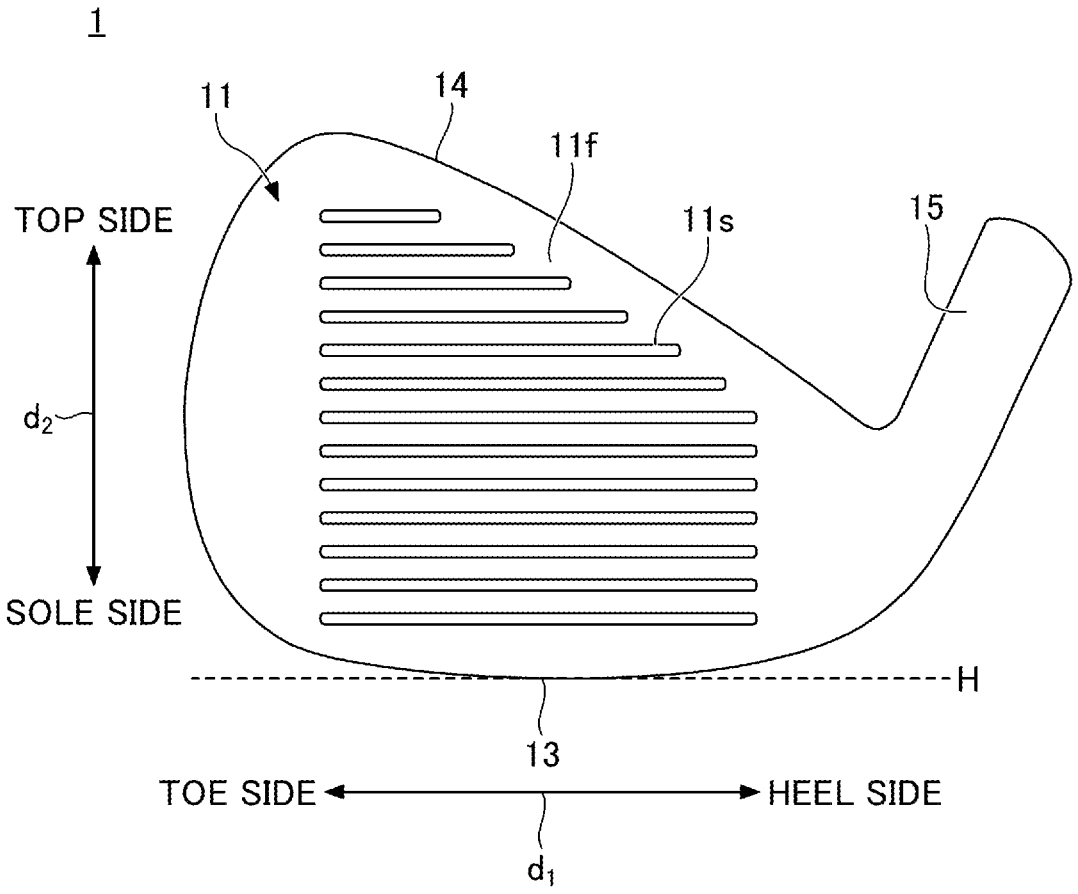
FIG. 1 is a front view illustrating an example of a golf club head 1 according to an embodiment.
Figure 2:
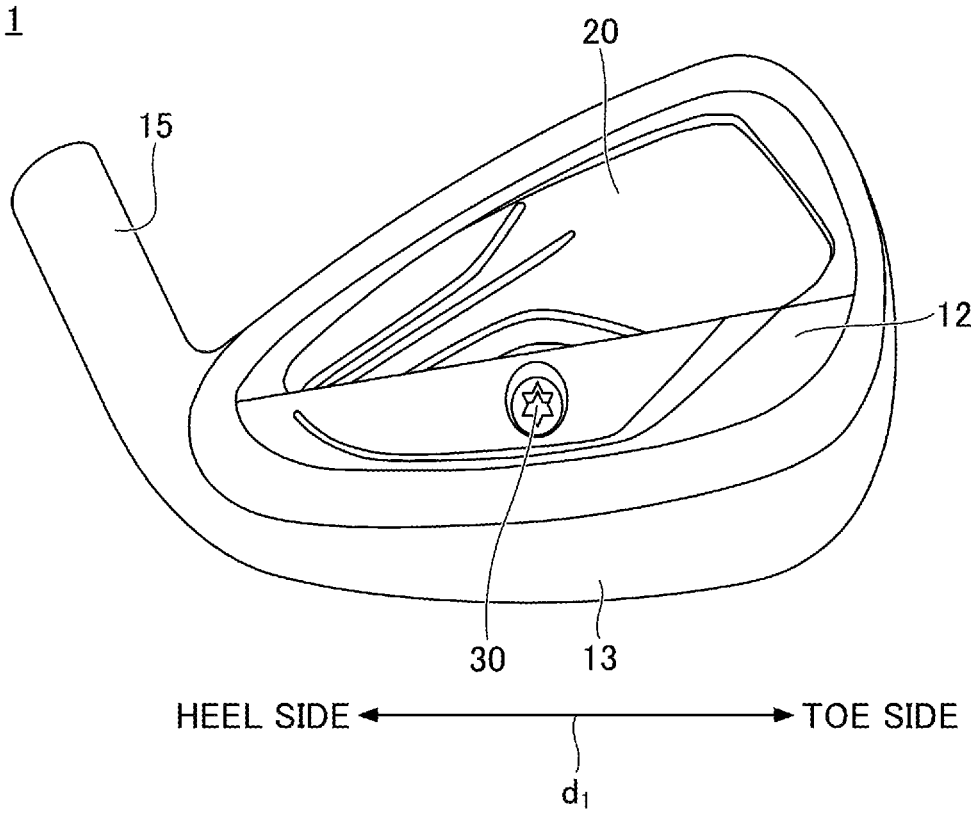
FIG. 2 is a rear view illustrating an example of the golf club head 1 according to the embodiment.
Figure 3:
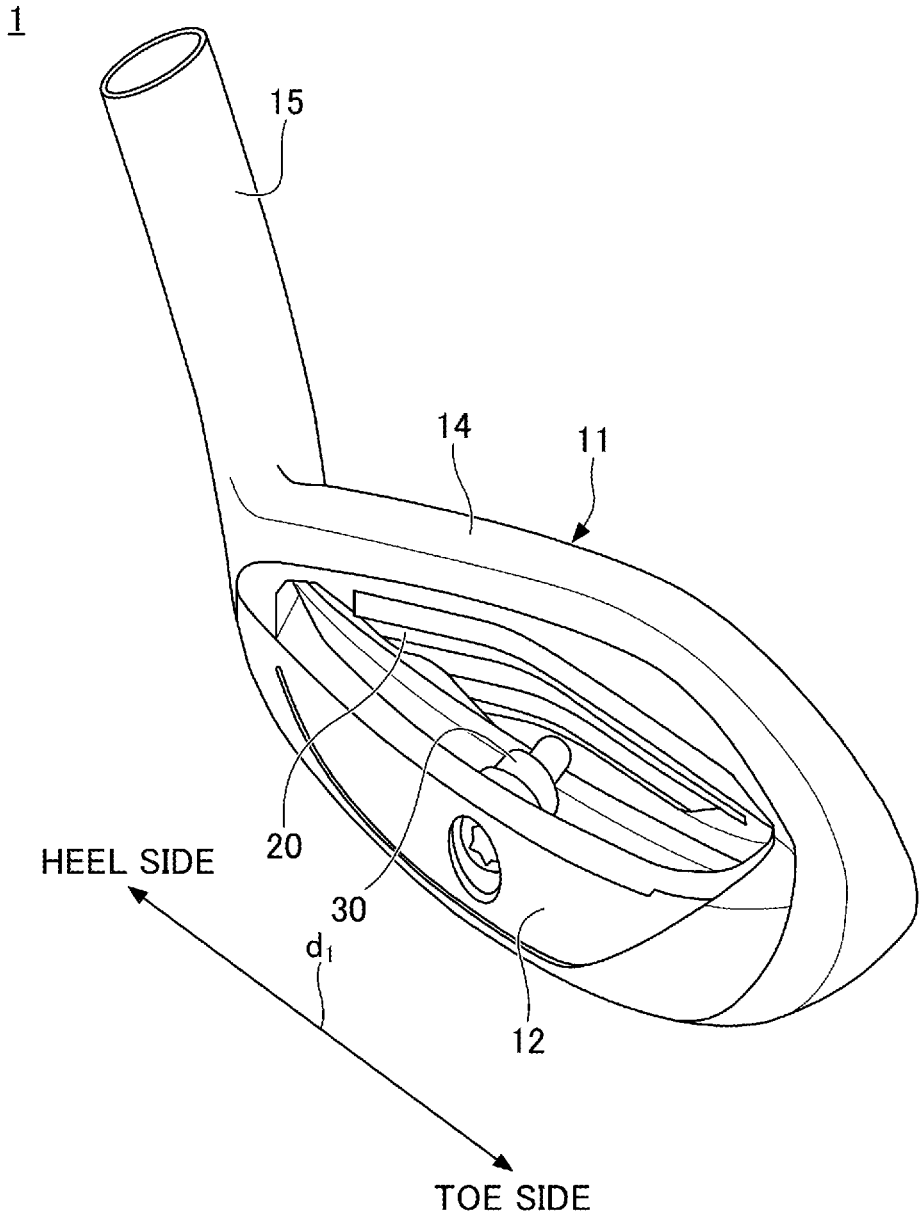
FIG. 3 is a perspective view illustrating an example of the golf club head 1 according to the embodiment.
Figure 4:
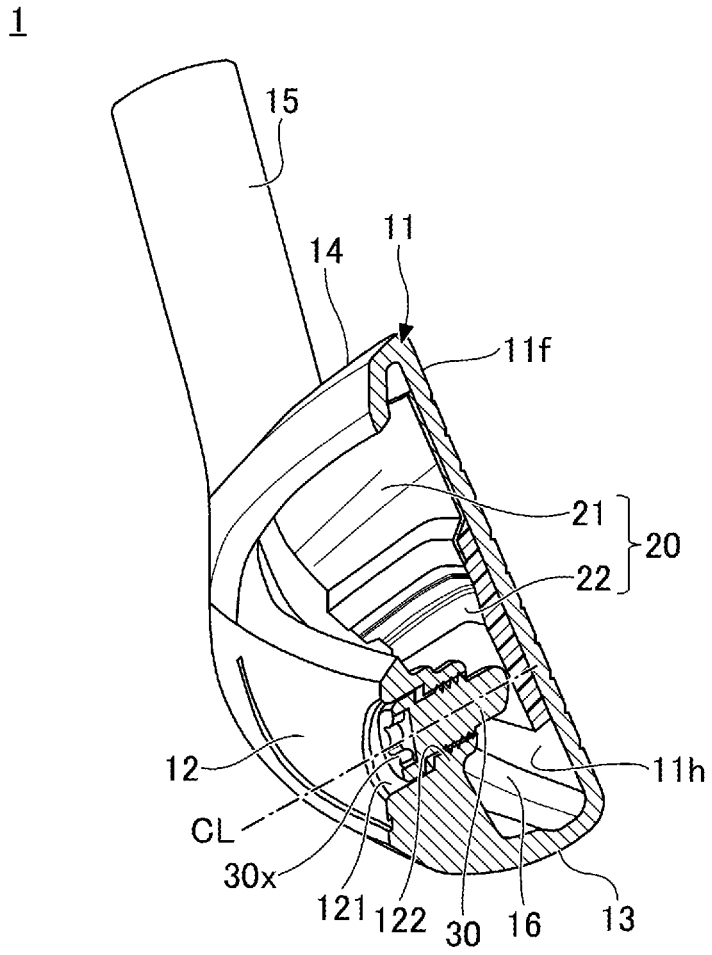
FIG. 4 is a cross-sectional view (part 1) illustrating the golf club head 1 according to the embodiment.
Figure 5:
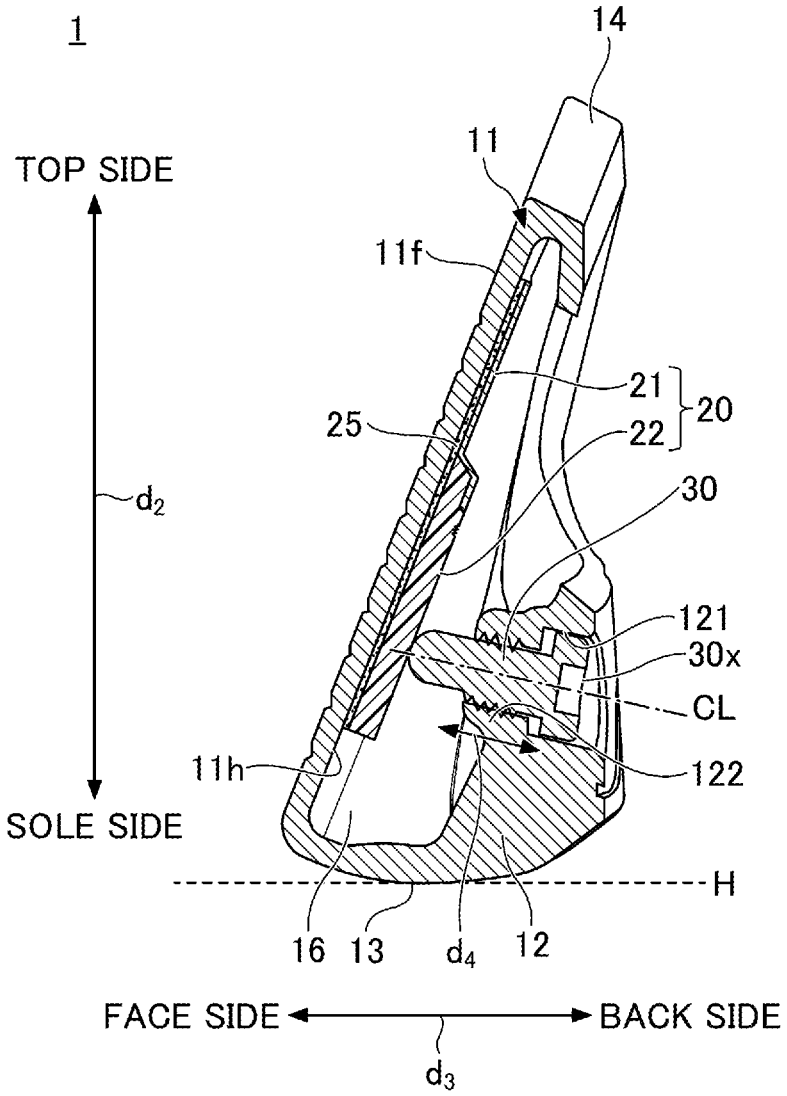
FIG. 5 is a cross-sectional view (part 2) illustrating the golf club head 1 according to the embodiment.

FIG. 1 is a front view illustrating an example of a golf club head according to the embodiment. FIG. 2 is a rear view illustrating an example of the golf club head according to the embodiment. FIG. 3 is a perspective view illustrating an example of the golf club head according to the embodiment, and is a view in which the back side of the golf club head is seen diagonally from above. FIGS. 4 and 5 each are a cross-sectional view illustrating an example of the golf club head according to the embodiment, and each illustrate a vertical cross-section taken along a face-back direction so as to pass through a central axis CL of an abutment portion 30 (to be described later).

Note that FIGS. 1 and 5 each illustrate a case where a golf club head 1 rests on a horizontal plane H (corresponding to the ground) in accordance with a reference lie angle and a reference loft angle. Further, in each drawing, arrows $d_1$, $d_2$, and/or $d_3$ are indicated as necessary. The arrow $d_1$ indicates a toe-heel direction (left-right direction), the arrow $d_2$ indicates a top-sole direction (up-down direction), and the arrow $d_3$ indicates a face-back direction (front-rear direction).

The golf club head 1 illustrated in FIGS. 1 to 5 is a cavity-back iron type golf club head. The golf club head 1 is applicable to any one of long irons, middle irons, short irons, or wedges.

The golf club head 1 may be made of a metal material, for example, soft iron, stainless steel, titanium, aluminum, or chromium-molybdenum steel. The golf club head 1 can be manufactured by, for example, forging, casting, machining, or by a combination thereof. However, the manufacturing method is not limited to these methods.

The golf club head 1 includes a face portion 11, a back portion 12, a sole portion 13, a top portion 14, and a hosel portion 15. The face portion 11 includes a front face 11*f* that serves as a ball-striking face configured to strike a ball and a rear face 11*h* that faces away from the front face 11*f*. The face portion 11 has a prescribed thickness. The thickness of a thinnest part of the face portion 11 without consideration to score lines is, for example, 1.5 mm or more and 2.2 mm or less. Note that the front face 11*f* may also be referred to as the ball-striking face.

A plurality of score lines 11*s* (grooves recessed from the front face 11*f* toward the rear face 11*h*) having the toe-heel direction as the lengthwise direction are arrayed on the front face 11*f* at predetermined intervals in the top-sole direction. Each score line 11*s* is parallel to the horizontal plane H. In the face portion 11, the area where the plurality of score lines 11*s* are formed on the front face 11*f* is the part that is to strike a golf ball.

A cavity portion 16 is provided behind the face portion 11. The cavity portion 16 extends from the toe side to the heel side. The sole side of the cavity portion 16 is surrounded by the face portion 11, the back portion 12, and the sole portion 13.

The back portion 12 constitutes part of the back side of the golf club head 1. The back portion 12 protrudes rearward from the face portion 11 in the lower part of the rear face 11*h*. The back portion 12 is provided to face the sole side of the face portion 11 in the face-back direction with the cavity portion 16 interposed therebetween. The back portion 12 extends from the toe side to the heel side.

The sole portion 13 is a portion forming the bottom of the golf club head 1. The top portion 14 is a portion extending rearward from the upper edge of the face portion 11. The top portion 14 is provided to face the sole portion 13 in the top-sole direction with the cavity portion 16 interposed therebetween. The top portion 14 extends from the toe side to the heel side. The hosel portion 15 is a portion configured to be coupled to a shaft.

The golf club head 1 includes a badge 20. The badge 20 is fixed to the rear face 11*h* of the face portion 11. The badge 20 can be fixed to the rear face 11*h* by, for example, a double-sided tape 25. Alternatively, an adhesive may be used instead of the double-sided tape 25. For example, the badge 20 extends from the toe side to the heel side. The badge 20 includes a metallic member 21 and a non-metallic member 22. The thickness of the metallic member 21 is, for example, 0.5 mm or more and 3 mm or less. The thickness of the non-metallic member 22 is, for example, 1 mm or more and 10 mm or less.

In the example illustrated each of FIGS. 4 and 5, the non-metallic member 22 is provided on the sole side of the rear face 11*h* of the face portion 11, and the metallic member 21 is provided on the top side of the rear face 11*h* of the face portion 11. Further, in the example illustrated in each of FIGS. 4 and 5, a sole-side end of the metallic member 21 is folded and contacts a top-side end of the rear surface of the non-metallic member 22. That is, the metallic member 21 includes a portion fixed to the rear face 11*h* and a portion facing the rear face 11*h* with a portion of the non-metallic member 22 interposed therebetween. The partial interposition of the non-metallic member 22 between the rear face 11*h* and the metallic member 21 that is provided by this structure inhibits the movement of the non-metallic member 22. Hence, this structure can restrict the non-metallic member 22 from moving or peeling off due to the impact transferred when a golf ball is struck.

The material of the metallic member 21 may be, for example, aluminum. The non-metallic member 22 may be made of a material that has a higher elasticity than the metallic member 21. A resin composition or a rubber composition can be selected as the material of the non-metallic member 22. A resin composition may be, for example, polyurethane, polyester, or a silicone. A rubber composition may be, for example, a synthetic rubber such as polybutadiene or a rubber composition containing natural rubber. In the interest of heat resistance during normal use, it is particularly preferable to use a thermosetting resin as the material for the non-metallic member 22.

Note that although the badge 20 includes two components in this embodiment, the badge 20 may include only a single component or may include three or more components.

The back portion 12 includes the abutment portion 30 that is passed through the back portion 12. A vertical cross-section of the abutment portion 30 is illustrated in FIGS. 4 and 5. As illustrated in FIGS. 4 and 5, the back portion 12 includes a recessed section 121 that is recessed rearward to the side where the cavity portion 16 is and a fastening section 122 that is provided in a section closer to the side where the cavity portion 16 is in the recessed section 121. The fastening section 122 is configured to connect the recessed section 121 to the cavity portion 16.

The recessed section 121 and the fastening section 122 are passed through the back portion 12. The horizontal cross-section of the recessed section 121 has a substantially circular shape. The horizontal cross-section of the fastening section 122 has a substantially circular shape with a smaller diameter than the recessed section 121. The recessed section 121 and the fastening section 122 are arranged concentrically. A step is provided at the boundary between the inner surface of the recessed section 121 and the inner surface of the fastening section 122.

The fastening section 122 is provided in a position spaced apart from the rear face 11*h* of the face portion 11 in the $d_3$ direction, and is configured to fasten the abutment portion 30 to the back portion 12. In other words, the fastening section 122 is where the abutment portion 30 is attached. A part or the entirety of the inner surface of the fastening section 122 is threaded. The step provided at the boundary between the inner surface of the recessed section 121 and the inner surface of the fastening section 122 functions as a stopper for the abutment portion 30 when the abutment portion 30 is fastened to the back portion 12.

Although the fastening section 122 according to the embodiment is positioned at substantially the center of the back portion in the $d_1$ direction, the fastening section 122 may be positioned closer to the toe side or the heel side of the back portion. Furthermore, although only one set of the fastening section 122 and the abutment portion 30 is provided in the embodiment, two or more sets of the fastening section 122 and the abutment portion 30 may be provided at different areas of the back portion.

The abutment portion 30 is fastened by the fastening section 122. The abutment portion 30 is a shaft-shaped member extending in a $d_4$ direction toward the side where the rear face 11*h* of the face portion 11 is. The central axis CL of the abutment portion 30 is parallel to the $d_4$ direction. In the abutment portion 30, a tip portion provided in the direction of the central axis CL contacts the back-side face (rear face) of the non-metallic member 22 of the badge 20.

Note that the $d_4$ direction is a direction that coincides with the $d_3$ direction when viewed in the top-sole direction, and is a direction that extends diagonally upward from the back side to the face side when viewed in the toe-heel direction. A line extending from the central axis CL that is parallel to the $d_4$ direction is not perpendicular to the rear face 11*h* of the face portion 11. That is, the central axis CL of the abutment portion 30 is not parallel to the normal direction of the rear face 11*h*, but intersects the normal direction of the rear face 11*h*. In other words, the abutment portion 30 contacts the rear face 11*h* of the face portion 11 at an oblique angle. This can reduce the concentration of stress on the abutment portion 30, the fastening section 122, or the portion of the face portion 11 in contact with the abutment portion 30 at impact. Although illustration has been omitted, it is preferable for the $d_4$ direction to fall within a range of inclination of ±20° with respect to the $d_3$ direction when viewed in the top-sole direction. Hence, the $d_4$ direction need not always coincide with the $d_3$ direction. The $d_4$ direction may extend diagonally downward from the back side to the face side when viewed in the toe-heel direction. The $d_4$ direction may be parallel to the normal direction of the rear face 11*h*.

Figure 6:
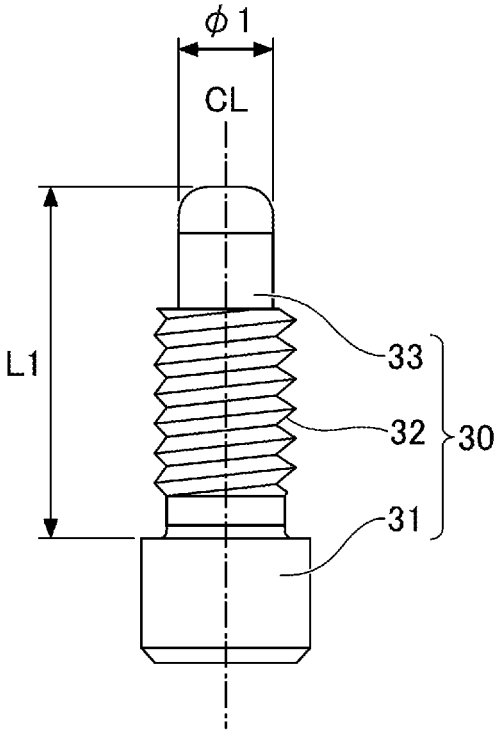
FIG. 6 is a side view of an abutment portion.

FIG. 6 is a side view of the abutment portion. In FIG. 6, the abutment portion 30 includes a screw head 31, a screw shaft 32 provided at one end of the screw head 31 in the direction of the central axis CL, and a tip portion 33 provided at an end of the screw shaft 32 on a side opposite to the screw head 31 in the direction of the central axis CL. The abutment portion 30 is a substantially cylindrical member including sections of different diameters. The screw head 31, the screw shaft 32, and the tip portion 33 are arranged concentrically. The screw shaft 32 includes a threaded outer surface.

The diameter of the screw shaft 32 is smaller than the diameter of the screw head 31. A diameter φ1 of the tip portion 33 is even smaller than the diameter of the screw shaft 32. The diameter φ1 of the tip portion 33 is, for example, 3.5 mm or more and 8 mm or less. A length L1 that is the total length of the screw shaft 32 and the tip portion 33 is, for example, 8 mm or more and 20 mm or less.

As illustrated in FIGS. 4 and 5, the screw head 31 includes a groove 30*x* having, for example, a hexagonal shape. The abutment portion 30 can be turned by inserting the tip of a hex wrench or the like in the groove 30*x*. Inserting the abutment portion 30 in the recessed section 121 and turning the abutment portion 30 therein causes the screw shaft 32 to be screwed to the fastening section 122, thus allowing the abutment portion 30 to be fastened to the fastening section 122.

The side of the tip portion 33 opposite to the screw shaft 32 in the direction of the central axis CL (that is, the side of the tip portion 33 that contacts the non-metallic member 22) is shaped so that its cross-sectional area (the area of its section perpendicular to the central axis CL) gradually decreases toward the end of the tip in a direction away from the screw shaft 32 along the central axis CL. That is, the tip portion 33 includes a curved surface, and the curved surface of the tip portion 33 contacts the non-metallic member 22. The portion of the tip portion 33 that contacts the non-metallic member 22 is in, for example, a hemispherical shape.

In the interest of increasing strength, it is preferable for the abutment portion 30 to be a component with a one-piece structure. That is, it is preferable for the abutment portion 30 to not include parts joined by, for example, welding or adhesive bonding. The abutment portion 30 may be made of metal such as aluminum, magnesium, titanium, iron, tungsten, or stainless steel (SUS).

In the interest of further improving the durability of the abutment portion 30, the Young's modulus of the abutment portion 30 is preferably 50 GPa or more, more preferably 90 GPa or more, and even more preferably 190 GPa or more.

While examples of the materials for the abutment portion 30 are as described above, examples of materials suitable for improving the durability of the abutment portion 30 include titanium and a titanium-based material (for example, a titanium alloy) having a Young's modulus of 90 GPa or more and stainless steel (SUS) having a Young's modulus of 190 GPa or more.

Furthermore, in cases where the interest is on weight reduction, aluminum and aluminum-based materials (for example, an aluminum alloy) having a Young's modulus of 50 GPa or more may be used as the materials for the abutment portion 30. Note that while the relative density of stainless steel (SUS) is approximately 7.8 and the relative density of titanium is approximately 4.5, the relative density of aluminum is approximately 2.7.

The part where the abutment portion 30 contacts the rear face 11*h* is the lower part of the face portion 11, specifically, the lower part of a face center. The abutment portion 30 being in contact with the lower part (a part on the side where the sole portion 13 is) of the face portion 11 restricts the deformation of the face portion 11 more in the lower part of the face portion 11 than in the upper part of the face portion 11. This contributes to an increase in the launch angle of a golf ball at impact.

Note that the face center can be identified as being at a position near the middle, between the toe and the heel, of the front face 11*f* in the $d_1$ direction and at a height near the middle, between the lowest position and the highest position, of the front face 11*f* in the $d_2$ direction when the sole portion 13 rests on the horizontal plane H at a prescribed lie angle and a prescribed loft angle. Here, letting an end in the toe-heel direction be 0% and letting the other end in the toe-heel direction be 100%, "near the middle" in the $d_1$ direction is defined as an area that falls within a range of 45% or more to 55% or less. Furthermore, letting one end in the top-sole direction be 0% and letting the other end in the top-sole direction be 100%, "near the middle" in the $d_2$ direction is defined as an area that falls within a range of 45% or more to 55% or less.

The position where the abutment portion 30 is fastened to the fastening section 122 can be adjusted in the direction (the $d_4$ direction) from the fastening section 122 toward the face portion 11. That is, the fastening position of the abutment portion 30 with respect to the fastening section 122 changes along the $d_4$ direction as the number of turns changes in accordance with the magnitude of the tightening torque of the screw shaft 32 with respect to the fastening section 122. Hence, it is possible to adjust the amount by which the abutment portion 30 protrudes from the face-side end surface of the fastening section 122 toward the face portion 11. That is, the torque from the screw shaft 32 being screwed to the fastening section 122 can change the distance between the rear face 11*h* and the tip portion 33 of the abutment portion 30 in the $d_4$ direction.

The screw shaft 32 of the abutment portion 30 is screwed to the fastening section 122 of the back portion 12 by being tightened by a torque of, for example, of 3 cN·m or more and 50 cN·m or less. The screw shaft 32 may be adhesively bonded to the fastening section 122 after being screwed.

In the abutment portion 30, the fastening position where the amount by which the abutment portion 30 protrudes from the fastening section 122 is at a maximum is a position where the outer peripheral portion of the screw head 31 of the abutment portion 30 contacts the step provided on the boundary between the inner surface of the recessed section 121 and the inner surface of the fastening section 122.

Even if there are individual differences in the abutment portion 30 and the fastening section 122, the tip portion 33 of the abutment portion 30 can be reliably brought into contact with the rear face 11*h* of the face portion 11 by adjusting the number of turns of the screw shaft 32 with respect to the fastening section 122. Further, the degree to which the abutment portion 30 presses the face portion 11 is changeable by adjusting the number of turns of the screw shaft 32 with respect to the fastening section 122. The tip portion 33 of the abutment portion 30 may be configured to contact the rear face 11*h* of the face portion 11 to an extent that the rear face 11*h* of the face portion 11 in a natural state is not pressed or is pressed toward the front face 11*f*.

In this manner, in the golf club head 1, the tip portion 33 of the abutment portion 30 being in contact with the rear face 11*h* of the face portion 11 restricts the deformation of the part of the face portion 11 that contacts the tip portion 33 of the abutment portion 30. The degree to which the deformation of the face portion 11 is restricted is changeable by adjusting the amount by which the abutment portion 30 protrudes from the fastening section 122. As a result, the value of the coefficient of restitution (COR) of the face portion 11 can be suppressed appropriately, and thus the golf club head 1 can be implemented in conformity with the "spring-like effect (SLE)" rule defined by the R&A.

Further, restricting the deformation of the face portion 11 allows the thickness of the face portion 11 to be reduced. For example, the thickness of the face portion 11 without consideration to the score lines can be reduced to 1.5 mm or more to 2.2 mm or less. In general, reducing the thickness of the face portion increases the repulsion of the face portion, leading to a concern that the COR value would exceed 0.83, which is the upper limit of the SLE rule. Thus, it is difficult to reduce the thickness of the face. However, in the golf club head 1, the deformation of the portion where the face portion 11 contacts the tip portion 33 is restricted by the tip portion 33 of the abutment portion 30 being in contact with the rear face 11*h* of the face portion 11. Hence, the COR value can be kept within the range of the SLE rule even when the thickness of the face portion 11 is reduced. As a result, the weight of the entire golf club head 1 can be reduced. Alternatively, the excess weight generated from reducing the thickness of the face portion 11 can be distributed to parts other than the face portion 11 so that performance adjustments, such as lowering of the center of gravity, can be made with respect to the golf club head 1.

Further, the tip portion 33 of the abutment portion 30 contacts the non-metallic member 22. If the tip portion 33 of the abutment portion 30 contacts a metal member, the force received from the face portion 11 at impact will have no place to escape, and the abutment portion 30 may break from the impact from the hitting of the ball. However, in the golf club head 1, the tip portion 33 of the abutment portion 30 is configured to contact the non-metallic member 22, and the non-metallic member 22 is deformed when the abutment portion 30 receives the force from the face portion 11. This configuration allows the force to escape from the face portion 11, thereby preventing the abutment portion 30 from breaking due to the impact from the hitting of the ball. That is, the golf club head 1 that includes the abutment portion 30 that has improved durability (breakage resistance) can be achieved.

Further, in the golf club head 1, the repulsion of the face portion 11 can be reduced intentionally by configuring the tip portion 33 of the abutment portion 30 to contact the rear face 11*h* of the face portion 11. Hence, the golf club head 1 can be designed to have a high repulsion over a wider area than golf club heads of the related art. Furthermore, since the deformation of the part of the face portion 11 that contacts the tip portion 33 of the abutment portion 30 is restricted, the stiffness distribution of the face portion 11 is such that the stiffness is relatively lower above the center and is relatively higher below the center. That is, the upper part of the face portion 11 is able to deflect more easily toward the back at impact. As a result, the launch angle of the ball can be increased when the ball is hit.

Further, in the golf club head 1, the tip portion 33 of the abutment portion 30 is curved and is in point contact with the rear face 11*h* of the face portion 11. That is, the tip portion 33 has, for example, a hemispherical shape, and a portion of the curved surface of the hemisphere contacts the rear face 11*h* of the face portion 11. Since the tip portion 33 contacts the rear face 11*h* of the face portion 11 via its curved surface, the abutment portion 30 is able to contact the rear face 11*h* in a uniform manner regardless of individual differences. Furthermore, since the tip portion 33 contacts the rear face 11*h* of the face portion 11 via its curved surface, the abutment portion 30 can be kept from excessively restricting the deformation of the face portion 11 at impact.

Figure 7:
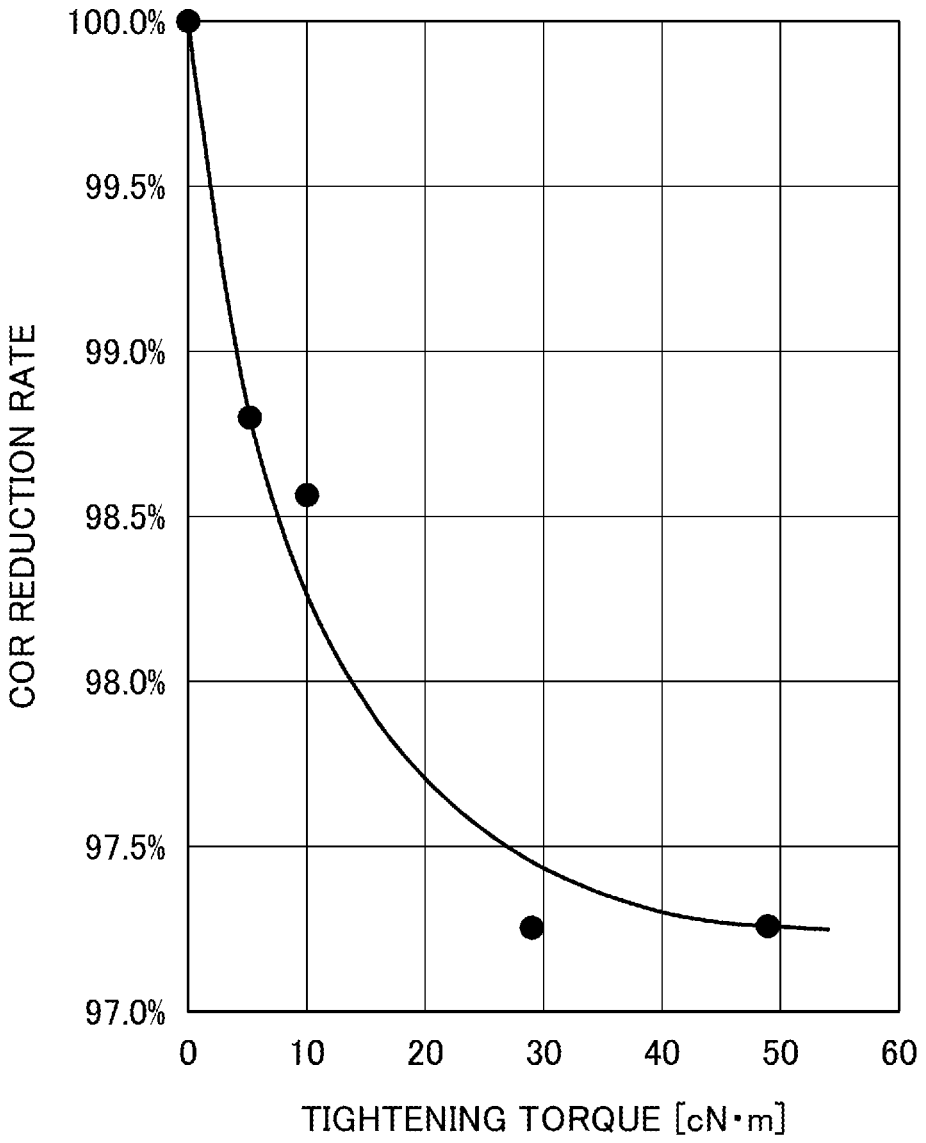
FIG. 7 is a graph illustrating an example of the change in a COR value when a protrusion amount of the abutment portion is adjusted.

FIG. 7 is a graph illustrating an example of the change in the COR value when the protrusion amount of the abutment portion is adjusted. In FIG. 7, the abscissa indicates the tightening torque [cN·m] between the fastening section 122 and the screw shaft 32, and the ordinate is the COR value. The COR value indicated in FIG. 7 has been obtained by measuring the speed of a golf ball when the golf ball has been struck by a robot and performing calculations based on the measured results.

As illustrated in FIG. 7, the protrusion amount of the abutment portion 30 can be adjusted by changing the tightening torque of the fastening section 122 and the screw shaft 32. As a result, the COR value can be set to a value that conforms to the SLE rule.

Although the embodiment has been described above, the present disclosure is not limited to the specific embodiment disclosed above, and various modifications and changes can be made without departing from the spirit and the scope defined in the appended claims.

For example, the above-described embodiment illustrated an example in which the non-metallic member 22 includes a part of the badge 20, the disclosure is not limited to this. The embodiment may include a structure in which the non-metallic member is fixed to the rear face 11*h* separately from the badge 20 and the abutment portion 30 contacts the non-metallic member.

Furthermore, the structure by which the abutment portion 30 is fastened to the back portion 12 is not limited to a screw structure, and may be a structure employing another fastening method such as press-fitting, bonding, welding, swaging or crimping.

What is claimed is:

1. A cavity-back iron type golf club head comprising:
- a face portion; and
- a back portion,
- wherein the face portion includes a front face and a rear face facing away from each other, the front face being a ball-striking face,
- wherein a non-metallic member is fixed to the rear face,
- wherein an abutment portion including a tip portion with a curved surface is provided on the back portion,
- wherein the abutment portion is passed through the back portion, and the curved surface of the tip portion contacts the non-metallic member,
- wherein the non-metallic member serves as a portion of a badge, and
- wherein the badge includes the non-metallic member and a metallic member, the metallic member including a portion fixed to the rear face and a portion facing the rear face with a portion of the non-metallic member interposed therebetween.

2. The cavity-back iron type golf club head as claimed in claim 1,
- wherein the back portion includes a fastening section with a threaded inner surface,
- wherein the abutment portion includes a screw shaft with a threaded outer surface, and
- wherein a distance between the rear face and the tip portion of the abutment portion is changeable by a torque from the screw shaft being screwed into the fastening section.

3. The cavity-back iron type golf club head as claimed in claim 2, wherein the abutment portion is screwed into the back portion by being tightened by a torque of 3 cN·m or more and 50 cN·m or less, and the abutment portion is adhesively bonded to the back portion.

4. The cavity-back iron type golf club head as claimed in claim 1, wherein a thickness of a thinnest part of the face portion is 1.5 mm or more and 2.2 mm or less.

5. The cavity-back iron type golf club head as claimed in claim 1, wherein the abutment portion has a Young's modulus of 50 GPa or more.

6. The cavity-back iron type golf club head as claimed in claim 1, wherein the abutment portion has a Young's modulus of 90 GPa or more.

7. The cavity-back iron type golf club head as claimed in claim 1, wherein the abutment portion has a Young's modulus of 190 GPa or more.

8. The cavity-back iron type golf club head as claimed in claim 1, wherein a material of the non-metallic member comprises either a resin composition or a rubber composition.

* * * * *